US005691122A

United States Patent [19]

O'Toole

[11] Patent Number: 5,691,122

[45] Date of Patent: Nov. 25, 1997

[54] PHOTOGRAPHIC PROCESSING COMPOSITION AND METHOD USING ORGANIC CATALYST FOR PEROXIDE BLEACHING AGENT

[75] Inventor: Terrence Robert O'Toole, Webster, N.Y.

[73] Assignee: Eastman Kodak Company, Rochester, N.Y.

[21] Appl. No.: 745,528

[22] Filed: Nov. 12, 1996

Related U.S. Application Data

[60] Division of Ser. No. 569,406, Dec. 6, 1995, which is a continuation-in-part of Ser. No. 362,384, Dec. 22, 1994, abandoned.

[51] Int. Cl.[6] ..... G03C 7/42

[52] U.S. Cl. ..... 430/430; 430/943

[58] Field of Search ..... 430/430, 943

[56] References Cited

U.S. PATENT DOCUMENTS

| | | | |
|---|---|---|---|
| 4,045,225 | 8/1977 | Shimamura et al. | 430/430 |
| 5,188,927 | 2/1993 | Okada et al. | 430/430 |
| 5,217,855 | 6/1993 | Okada et al. | 430/430 |
| 5,223,379 | 6/1993 | Okada et al. | 430/430 |
| 5,236,814 | 8/1993 | Kuse et al. | 430/430 |
| 5,250,401 | 10/1993 | Okada et al. | 430/430 |
| 5,250,402 | 10/1993 | Okada et al. | 430/430 |
| 5,316,898 | 5/1994 | Ueda et al. | 430/430 |
| 5,338,649 | 8/1994 | Inaba et al. | 430/430 |
| 5,409,804 | 4/1995 | Inaba et al. | 430/393 |
| 5,510,232 | 4/1996 | O'Toole | 430/430 |

FOREIGN PATENT DOCUMENTS

| | | |
|---|---|---|
| 428101 | 11/1989 | European Pat. Off. . |
| 3234467 | 10/1981 | Germany . |
| 61/261739 | 6/1985 | Japan . |

*Primary Examiner*—Hoa Van Le

*Attorney, Agent, or Firm*—J. Lanny Tucker

[57] ABSTRACT

Certain organic carbocyclic and heterocyclic compounds are useful catalysts for hydrogen peroxide bleaching agents in photographic processing methods. These compounds are oxidizable by hydrogen peroxide and reducible by silver metal at a pH of from 1 to 7, and have a chemically reversible redox couple of from about −0.20 to about +1.0 volts at the same pH. The hydrogen peroxide bleaching ability is enhanced by the presence of these compounds which can be used in the bleaching solution itself, or in a prebath solution. The combination of the organic compound with a transition metal ion co-catalyst provides a synergistic effect in bleaching acceleration.

14 Claims, 1 Drawing Sheet

PHOTOGRAPHIC PROCESSING COMPOSITION AND METHOD USING ORGANIC CATALYST FOR PEROXIDE BLEACHING AGENT

This is a Divisional of U.S. application Ser. No. 08/569,406, filed Dec. 06, 1995 which is a continuation-in-part of U.S. Ser. No. 08/362,384 filed Dec. 22, 1994 now abandoned.

FIELD OF THE INVENTION

The present invention relates generally to the processing of photographic elements. More particularly, it relates to the use of certain organic compounds as catalysts for peroxide bleaching agents. The solutions containing these organic compounds and methods for their use in photography are the subject of this invention.

BACKGROUND OF THE INVENTION

During processing of silver halide photographic elements, the developer is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions which are more compatible with the environment, and thus it is desirable to reduce or avoid the use of ferric ions and many of the common complexing ligands such as ethylenediaminetetraacetic acid and propylenediaminetetraacetic acid, which are not readily biodegradable.

Peroxide bleaching solutions, such as those containing hydrogen peroxide, or a peroxide precursor such as perborate or percarbonate, bleaching agents, offer an alternative to the ferric complex bleaching solutions. They are less expensive, and present lower chemical and biological demands on the environment since their by-products can be less harmful.

However, there are certain problems associated with peroxide bleaching solutions. For example, acidic peroxide bleaching solutions are described in U.S. Pat. No. 4,277,556 (Koboshi et al) which may contain metal ions as catalysts to improve the bleaching efficiency of the peroxide. Some of these solutions are stable, but they are not rehalogenating or silver retentive (that is, the developed silver can be oxidized to a soluble salt, and undeveloped silver halide remains in the element). This complicates silver recovery. Other peroxide bleaching solutions are known which contain a ferric ion complex as a catalyst, as described in U.S. Pat. No. 4,301,236 (Idota et al). Such solutions are rehalogenating, but lack stability as iron is a well-known catalyst for peroxide decomposition. In addition, the only examples show the use of EDTA which is undesirable because of its non-biodegradability.

Thiols have been described as bleaching catalysts in some literature (JP-A-61/261739), but no demonstration of their effect was provided. Nonetheless, thiols are undesirable as catalysts because of their objectionable odors.

EPA-0 428 101 describes alkaline peroxide bleaching solutions which are rehalogenating, but such solutions lack sufficient stability and are claimed to bleach photographic elements containing silver chloride only.

Other concerns with peroxide bleaching solutions include the potential for vesiculation, that is the blistering in the element caused by the breakdown of peroxide into water and oxygen gas.

There remains a need, therefore, for highly efficient peroxide bleaching solutions which do not suffer from the problems noted above, that is, they are rehalogenating, stable and useful for a variety of photographic elements, and lack objectionable odors.

SUMMARY OF THE INVENTION

The present invention provides a solution to the problems noted above with a method for processing a photographic element comprising:

treating an imagewise exposed and developed photographic element with a solution that is substantially free of ferric ions, and comprises from about 0.0005 to about 0.1 mol/l of an organic carbocyclic or heterocyclic compound which has the following properties:

a) a reduced form which is oxidizable by peroxide or a peroxide precursor at a pH of from about 1 to about 7, b) an oxidized form which is reducible by silver metal in the presence of bromide or chloride at a pH of from about 1 to about 7, and c) a chemically reversible redox couple, versus a saturated calomel electrode, of from about −0.20 to about +1.0 volts at a pH of from about 1 to about 7.

The present invention also provides a photographic bleaching solution that is substantially free of ferric ions, and has a pH of from about 1 to about 7, and comprises from about 0.0005 to about 0.1 mol/l of the organic carbocyclic or heterocyclic compound described above. This bleaching solution also includes hydrogen peroxide.

The method of this invention provides rapid and efficient bleaching of the imagewise exposed and developed photographic elements and avoids the problems noted above with known methods. The specific organic compounds described herein effectively catalyze the hydrogen peroxide bleaching action. In addition, the bleaching solution is rehalogenating and useful with various silver halide emulsions. It is also an advantage that the organic compounds can be used in the bleaching solution or in processing prebaths (no bleaching agent) used prior to bleaching. Some of the organic compounds described herein are best used in the pre-bath solutions instead of in bleaching solutions.

These advantages are possible with the use of the particular organic carbocyclic or heterocyclic compounds which have certain properties: (1) they have reduced forms which are oxidizable by peroxide or a peroxide precursor at a pH of from about 1 to about 7, (2) they have oxidized forms which are reducible by silver metal in the presence of bromide or chloride at the same pH, and (3) they have a chemically reversible redox couple of from about −0.20 to about +1.0 volts at a pH of from about 1 to about 7. From about 0.0005 to about 0.1 mol/l of the compound is used in the processing solution.

DETAILED DESCRIPTION OF THE INVENTION

Figure 1:
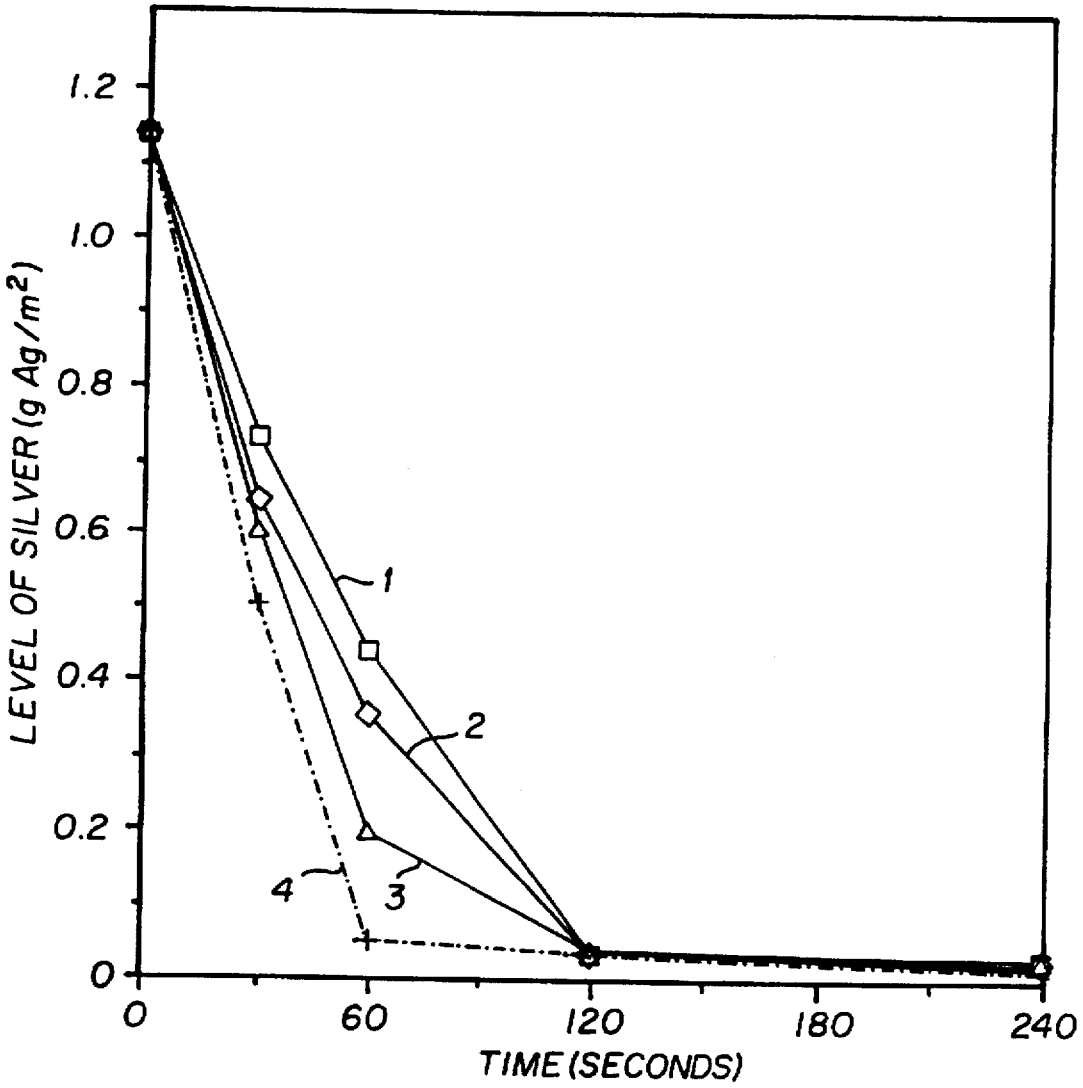
FIG. 1 is a graphical plot of the amount of silver metal retained over time during peroxide bleaching of a color photographic element described in Example 23 below.

The organic compounds useful as catalysts in the practice of this invention have a chemically reversible redox couple between about −0.20 and about +1.0 volts, as measured against a saturated calomel electrode (as defined by Bard et al, *Electrochemical Methods*, John Wiley & Sons, 1980, p.44). Preferably, the redox couple is from about −0.1 to about +0.5 volt. Generally, such organic compounds are carbocyclic or heterocyclic compounds, including but not limited to, quinones, aromatic diamines, aminophenols, pyridiniums, thiazines, oxazines, phenazines and other compounds which would be readily apparent from the teaching provided herein.

The organic catalysts can have a net positive or neutral charge. It is preferred that they have a net positive charge, and thus also have a corresponding anion which can be a halide (such as bromide, chloride or iodide), sulfate, sulfite, carbonate, nitrate, nitrite, phosphate, phosphite, carboxylate, sulfonate, phosphonate or another anion which would be readily apparent to one skilled in the art.

With respect to the organic catalysts having a net positive charge, the one or more positive charges can be provided by a quaternized amine within the heterocyclic ring structure, or by pendant positively charged monovalent groups on the carbocyclic or heterocyclic ring.

The organic catalysts are preferably represented by one of the following structures (I)–(IV):

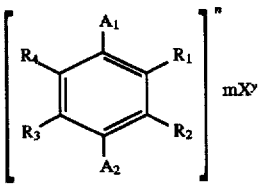
(I)

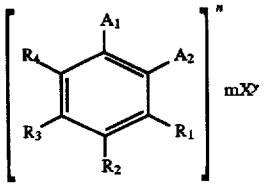
(II)

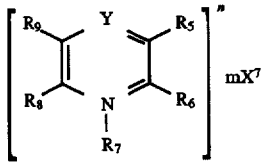
(III)

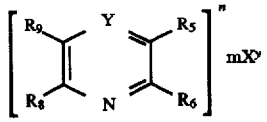
(IV)

wherein $A_1$ and $A_2$ are independently hydroxy or primary, secondary or tertiary amino. Such amino groups can be substituted with a linear or branched, substituted or unsubstituted alkyl group of 1 to 12 carbon atoms (such as methyl, ethyl, isopropyl, t-butyl, hexyl and benzyl) or a substituted or unsubstituted cycloalkyl group having 5 to 10 carbon atoms (such as cyclopentyl and cyclohexyl). Preferably, each of $A_1$ and $A_2$ is hydroxy or tertiary amino. Structures (I) and (II) can also exist in their oxidized forms wherein $A_1$ and $A_2$ can be oxo or a quaternized imine. In addition, structures (III) and (IV) can exist in their reduced forms.

In the foregoing structures, $R_1$, $R_2$, $R_3$, $R_4$, $R_5$, $R_6$, $R_7$, $R_8$ and $R_9$ are independently hydrogen, halo (such as chloro, bromo and iodo), cyano, nitro, amide, sulfonamide, hydroxy, an ester (such as acetate or benzoate), an ether, a primary, secondary or tertiary amino (for example, an amine substituted with a linear or branched, substituted or unsubstituted alkyl group as described above), a linear or branched, substituted or unsubstituted alkyl group of 1 to 12 carbon atoms (as described above), a substituted or unsubstituted aryl group of 6 to 12 carbon atoms in the ring structure (such as phenyl, tolyl, xylyl, naphthyl and anthryl), a substituted or unsubstituted cycloalkyl group of 5 to 12 carbon atoms in the ring structure (such as cyclopentyl, cyclohexyl and 4-methylcyclohexyl) or a quaternized aliphatic or aromatic amine or imine. Preferably, at least one of the $R_1$ through $R_9$ groups is a quaternized aliphatic or aromatic amine or imine.

The term "ring structure" is meant to refer to one or more fused rings in the same molecule.

Such amines and imines can be represented by either structure (V) or (VI):

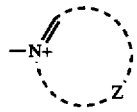
V

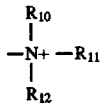
VI wherein Z represents the carbon, oxygen, nitrogen and sulfur atoms necessary to complete a substituted or unsubstituted 5- to 12-membered aromatic ring structure including, but not limited to, a pyridyl, pyrimidinyl, pyrazinyl, pyridizinyl, quinolinyl, quinoxalinyl, azonyl, thiazolyl, isopyrrolyl, pyrazolyl, imidazolyl, oxazolyl, isoxazolyl, oxadiazolyl, oxatriazolyl, dioxazolyl, triazinyl, oxazinyl, oxathiazinyl, diazepinyl, indolyl, isodinazolyl, quinolyl, isoquinolyl, indoxazinyl, quinazolinyl, pyridopyridyl, cinnolinyl, benzoxazinyl, pteridinyl, quinolinyl, pyrrolyl, thiopenyl, pyranyl and furazanyl ring.

$R_{10}$, $R_{11}$ and $R_{12}$ are independently a linear or branched, substituted or unsubstituted alkyl group of 1 to 12 atoms (as defined above), or a substituted or unsubstituted cycloalkyl group of 5 to 12 carbon atoms in the ring structure (as defined above).

Alternatively, any two adjacent groups chosen from $R_1$, $R_2$, $R_3$, $R_4$, $R_5$, $R_6$, $R_7$, $R_8$ and $R_9$, can represent the carbon, nitrogen, oxygen and sulfur atoms necessary to complete a substituted or unsubstituted 5- to 12-membered fused carbocyclic or heterocyclic ring structure connected to the primary nucleus of structures (I)–(IV). Representative carbocyclic and heterocyclic ring structures are described above, but others include thiophenyl, furanyl, pyronyl, dioxinyl, oxazinyl, pyranyl, dioxazolyl and cyclohexenyl. It should be understood that such ring structures can have one or more positive charges provided by cyclic quaternary amine or imines and can be substituted with one or more monovalent groups described above in defining $R_1$ through $R_9$.

In structures (III) and (IV), Y is a sulfur, oxygen or nitrogen atom, and preferably, it is nitrogen in structure (III) and oxygen or sulfur in structure (IV). X is an anion having a charge defined by "y" which is from −1 to −3. Useful anions are described above.

Also, m is the absolute value of the ratio of "n" to "y". In structures I–IV, n is 0 or a positive integer of 1 to 3.

Particular compounds useful herein as catalysts include, but are not limited to:

5,8-dihydroxy-4a-azoniaanthracene bromide (Compound 1), 5,6-dihydroxy-4a-azoniaanthracene bromide (Compound 2), N-(2,5-dihydroxyphenyl)pyridinium chloride (Compound 3), N-[methyl(2,5-dihydroxy-4-methylphenyl)]pyridinium chloride (Compound 4), N-[methyl (2,5-dihydroxy-4-methyl)]isoquinolinium chloride (Compound 5), N-[(methyl(2,5-dihydroxy-4-methyl)]quinolinium chloride (Compound 6), 2,5-dihydroxyphenyltrimethylammonium chloride (Compound 7), N,N'-di(2,5-dihydroxyphenyl)-4,4'-bipyridinium dichloride (Compound 8), hydroquinone (Compound 9), bromohydroquinone (Compound 10), 2,5-dibromohydroquinone (Compound 11), tetrabromohydroquinone (Compound 12), methylhydroquinone (Compound 13), 2,5-dimethylhydroquinone (Compound 14), tetramethylhydroquinone (Compound 15), catechol (Compound 16), 1,3-dihydroxynaphthalene (Compound 17), 1,2-dihydroxynaphthalene (Compound 18), 4-(N,N-dimethylamino)phenol (Compound 19), 2-bromo-4-(N,N-dimethyl)phenol (Compound 20), 2-methyl-4-(N,N'-dimethylamino)phenol (Compound 21), N,N,N',N'-tetramethylparaphenylenediamine (Compound 22), bromo-N,N,N',N'-tetramethylparaphenylenediamine (Compound 23), methyl-N,N,N',N'-tetramethylparaphenylenediamine (Compound 24), Bindshedler's Green (Compound 25), N-methylphenazinium methosulfate (Compound 26), phenazine (Compound 27), phenoxazine (Compound 28), and phenothiazine (Compound 29).

Compounds 1 and 26 are most preferred in prebath solutions while Compounds 1, 9 and 26 are most preferred in bleaching solutions.

In the most general sense, the amount of organic catalyst present in the solution is from about 0.0005 to about 0.1 mol/l. From about 0.001 to about 0.01 mol/l is preferred and from about 0.001 to about 0.005 mol/l is most preferred. A mixture of the described organic compounds can be used if desired, as long as they do not interfere with each other in any way, for example diminish catalytic effect or cause precipitation.

The solution containing the organic catalyst can have a pH of from about 1 to about 7. When the solution containing the organic catalyst is a bleaching solution, the pH is preferably from about 3 to about 5. If the solution is used as a prebath solution, the pH may be different within the general range of from about 1 to about 7, but preferably, it is from about 3 to about 5 also. Various buffers may be present to maintain a desired pH in amounts which would be readily apparent to one skilled in the art. Such materials include, but are not limited to, organic or inorganic monobasic, dibasic and tribasic acids or protonated amines having at least one pKa between 1 and 9. Specifically useful buffers include acetate, 2-methylacetate, maleate, glycolate, succinate, imidazole, 3-morpholino-2-hydroxypropane, 4-sulfophthalate, trimellitate, bisulfate and dihydrogen phosphate. Mixtures of buffers can also be used. Buffer counterions may include sodium, potassium, ammonium and tetraalkylammonium ions among others readily apparent to one skilled in the art. The amount of buffer used is generally from about 0.01 to about 2 mol/l, with from about 0.05 to about 1 mol/l being preferred.

Some of the organic compounds useful herein as catalysts can be obtained from a number of commercial sources including, but not limited to, Aldrich Chemical Company. In addition, preparatory procedures are also well known for many of the compounds from the literature, or are readily apparent to one skilled in the art using known organic chemistry and conventional starting materials.

As noted above, the organic catalysts can be used in hydrogen peroxide bleaching solutions. Such solutions contain the conventional peroxide bleaching agents, including, but not limited to, hydrogen, alkali and alkaline earth salts of peroxide, and such peroxide precursors (that is, reactive to provide peroxide at solution pH) such as perborate and percarbonate. Persulfate is not a peroxide precursor in the practice of this invention (the pH is too high). Examples of such bleaching solutions are well known and described, for example, in *Research Disclosure*, publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "Research Disclosure".

Especially preferred bleaching solutions are those containing hydrogen peroxide.

The amounts of bleaching agents used in such solutions are well known in the art. For example, the amount of peroxide or peroxide precursor is generally from about 0.1 to about 2 mol/l.

In a preferred embodiment of this invention, the bleaching solution also comprises one or more rehalogenating agents, such as a halide (for example, chloride or bromide). The rehalogenating agent is generally present in an amount of from about 0.02 to about 2 mol/l with from about 0.05 to about 0.5 mol/l being more preferred. Any acceptable counterion can be used with the rehalogenating agent. Ammonium is preferred for water solubility, but potassium or sodium may also be desirable for environmental reasons.

The solutions containing the organic catalyst are also substantially free of ferric ion salts or complexes. By "substantially free" is meant less than about 0.0005 mol/l.

Other addenda commonly added to bleaching solutions can also be included, such as corrosion inhibitors, optical whitening agents, defoaming agents, calcium chelating agents, halogen scavengers, peroxide stabilizers, radical scavengers and other materials readily apparent to one skilled in the art. The compositions can be formulated as working bleaching solutions, solution concentrates or as dry powders or tablets.

It is sometimes desirable that the bleaching solution, or a prebath to that bleaching solution, also contain a small amount of a transition metal ion as a co-catalyst. Such ions will generally have a metal oxidation state of (I), (II) or (III), and can be provided in the form of conventional inorganic salts, or as organic salts or complexes (such as amine and diimine complexes), many of which are readily available from commercial sources or manufacturable using known procedures.

As shown in the examples below, these metal ions are generally not good catalysts by themselves at the concentrations specified herein. It has been found, however, that the presence of a small amount of these ions can greatly enhance the catalytic activity of the organic catalyst.

The most preferred transition metal ion co-catalysts include, but are not limited to, salts or complexes of copper (I), copper(II), cobalt(II), cobalt (III) or nickel(II). Copper (II) is most preferred. It can be supplied, for example, as part of an inorganic salt or as a copper(II) diimine ligand complex such as the bipyridine complexes described, for example, in copending and commonly assigned U.S. Ser. No. 08/363,106, filed Dec. 22, 1994, by O'Toole, Sistare and Schmittou, and entitled "Processing of Photographic Elements Using Copper Ligand Complexes to Catalyze Peracid Bleaching Agents". Salts or complexes of iron are not desired in this invention as co-catalysts because they have a strong tendency to catalyze hydrogen peroxide decomposition.

The amount of transition metal ions used herein is generally from about 0.0001 to about 0.05 mol/l, and more preferably from about 0.0005 to about 0.002 mol/l. The amounts may vary with the particular transition metal ion and organic catalyst used. The transition metal ion can be present in the same solution containing the organic catalyst or in a separate solution.

In a preferred embodiment of this invention, the organic catalyst is used in a separate "prebath" solution prior to the bleaching step. Such prebath solutions contain the catalyst in amounts as described above and have the noted pH, with or without buffers. Weak or strong acids may be present to adjust the pH. Buffers can be included with appropriate counterions, as would be understood by one skilled in the art. Other addenda in such prebath solutions include, but are not limited to, those addenda optionally used in bleaching solutions, noted above. Such prebath solutions contain no bleaching agents, such as peroxide, persulfate or iron complexes.

In still another embodiment, the catalyst can be included in what are known as developer "stop" solutions having a pH of from about 1 to about 7 (preferably from about 1 to about 5). One or more suitable buffers (such as acetate or bisulfate) are included at a concentration of from about 0.1 to about 4 mol/l (preferably from about 0.2 to about 2 mol/l). Such solutions can also include compounds to stop development, and the transition metal ion co-catalysts described above.

When the prebath or developer stop solution contains the organic catalyst, the bleaching solution generally does not. However, in one embodiment, both the prebath and bleaching solutions contain the same or different organic catalysts. One or both solutions can also contain the same or different transition metal co-catalyst. Thus, a first organic catalyst can be used in the prebath solution, and a second organic catalyst can be used in the bleaching solution. The same or different transition metal ion co-catalyst can also be included in the solutions.

In yet another embodiment, a fixing step can precede use of the organic catalyst.

There can optionally be an intermediate wash step between the use of a prebath or developer stop containing the organic catalyst and the bleaching step. The wash solution can be merely water, or a suitable acidic rinse comprising one or more weak or strong acids which would be readily known to one skilled in the art.

The operating temperature for using the prebath or bleaching solution containing the organic catalyst is generally from about 10° to about 60° C., and preferably from about 25° to about 50° C.

As used herein, in defining amounts of materials, the term "about" refers to ±20% of the indicated value. In defining pH, it refers to ±0.5 pH unit, and in defining temperature, it refers to ±5° C. In defining redox potential, it refers to ±0.2 volts.

Thus, in a preferred embodiment of this invention, a hydrogen peroxide bleaching solution of this invention comprises:

one or more organic catalysts as described above, and one or more compounds selected from the group consisting of:

a rehalogenating agent, a defoaming agent, a halogen scavenger, a calcium chelating agent, a corrosion inhibitor, an optical whitening agent, and a transition metal (II) or (III) ion co-catalyst (as described above).

Conventional fixing solutions can be used at an appropriate time in the processing of the elements. Such solutions contain fixing agents, such as thiosulfates, thioethers, thiocyanates, amines, mercapto-containing compounds, thioamides, thioureas, iodides and others which would be readily apparent to one skilled in the art. Particularly useful fixing agents include, but are not limited to, ammonium thiosulfate, sodium thiosulfate, potassium thiosulfate, guanidine thiosulfate, and various thioethers. Useful and optimum amounts of fixing agents would be readily apparent to one skilled in the art, and are generally from about 0.1 to about 3 mol/l.

This fixing solution can also contain a preservative such as a sulfite (such as ammonium sulfite) a bisulfite or a metabisulfite, or a fixing accelerator.

If desired, the organic catalysts described herein, if having a net charge, can be recovered using conventional ion exchange resins and procedures after their use in processing photographic elements.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure*, noted above. All types of emulsions can be used in the elements, including but not limited to, thin tabular grain emulsions, and either positive-working or negative-working emulsions. The elements can be either photographic film or paper elements.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Development is then followed by the use of a solution containing an organic catalyst as described herein. The bleaching and fixing steps can be carried out in any suitable fashion, as is known in the art. Subsequent to bleaching and fixing, a final washing or stabilizing step may be employed. Color prints and films can be processed using a wide variety of processing protocols, as described for example, in *Research Disclosure*, noted above.

The following examples are presented to illustrate the practice of this invention, and are not intended to be limiting in any way. Unless otherwise indicated, all percentages are by weight.

EXAMPLES 1–23

Use of Catalysts in Peroxide Bleaching and Prebath Processing

Several processing compositions (or processing solutions) of this invention were compared to several Control solutions outside the scope of this invention to evaluate the catalytic effect of several organic catalytic compounds described herein.

Samples of KODAK GOLD PLUS™ 100 photographic film were exposed for 0.5 second with 5500K illumination, and processed using the following protocol to yield 1.24 $g/m^2$ of developed silver metal:

| | |
|---|---|
| 3.25 minutes | Development* |
| 1 minute | Stop solution (1% v/v $H_2SO_4$) |
| 1 minute | Water wash |
| 4 minutes | Fixing** |
| 3 minutes | Water wash |
| 1 minute | KODAK PHOTO-FLO ™ rinse |
| 5 minutes | Dry |

*The developing solution (per liter) was an aqueous solution of potassium carbonate (34.3 g), potassium hydrogen carbonate (2.3 g), sodium sulfate (3.7 g), potassium iodide (1.2 mg), sodium bromide (1.3 g), diethylenetriaminepentaacetic acid (40% w/w, 8.4 g), hydroxylamine sulfate (2.4 g) and KODAK ™ Color Developing Agent CD4 (4.5 g), and had a pH of 10.05.
**The fixing solution (per liter) was an aqueous solution of sodium metabisulfite (11.8 g) and a solution (162 ml) of ammonium thiosulfate (56.5%) and ammonium sulfite (4%), and had a pH of 6.5.
KODAK PHOTO-FLO ™ is a commercially available rinse.

For Examples 1–22 and Controls A–H, the developed film samples were mounted in an optically transparent cell which was fitted within a conventional UV/visible spectrophotometer. As the bleaching solution was passed over the film sample, the loss in optical density was monitored at 820 nm and 25° C. The loss in optical density is directly related to the bleaching of silver metal to silver halide.

The basic bleaching solution (Control A), contained hydrogen peroxide (0.98 mol/l, 3% w/w), sodium bromide (0.15 mol/l) and sodium acetate (0.04 mol/l). The pH was adjusted to 3.7 with acetic acid (0.26 mol/l).

Table I below lists the organic catalysts, metal co-catalysts and the solutions in which they were used for the various Examples and Controls and the resulting bleaching effects. The parameter $t_{50}$ refers to the time (seconds) needed to bleach 50% of the available silver. When an organic catalyst was used in the bleaching or prebath solutions, its concentration was 5 mmol/l (except for Control B, see below). When a metal ion co-catalyst was used in either solution, its concentration was 2 mmol/l. When a prebath solution was used, the developed film sample was treated in that solution for 1 minute, followed by a water wash for 1 minute prior to bleaching.

A film sample was also processed with Process C-41, FLEXICOLOR™ Bleach III solution containing ferric propylenediaminetetraacetic acid complex as the bleaching agent. A $t_{50}$ of 32 seconds was observed. While this commercially available bleaching solution provides rapid bleaching, the aim of the industry is to find replacements for such bleaching solutions because of environmental concerns.

TABLE I

| | Prebath | | Bleach | | |
|---|---|---|---|---|---|
| Experiment | Organic Catalyst | Co-Catalyst | Organic Catalyst | Co-Catalyst | $t_{50}$ (seconds) |
| Control A | † | † | none | none | * |
| Control B | AB-1a | none | none | none | * |
| Control C | † | † | none | $Co(bpy)3^{2+}$ | * |
| Control D | † | † | none | $Ni(bpy)3^{2+}$ | * |
| Control E | † | † | none | $CuSO_4$ | 165 |
| Example 1 | † | † | Compound 26 | none | 63 |
| Example 2 | † | † | Compound 26 | $CuSO_4$ | 20 |
| Example 3 | Compound 26 | none | none | none | * |
| Example 4 | Compound 26 | none | none | $Co(bpy)3^{2+}$ | 81 |
| Example 5 | Compound 26 | none | none | $Ni(bpy)3^{2+}$ | 85 |
| Example 6 | Compound 26 | none | none | $CuSO_4$ | 21 |
| Control F | none | $CuSO_4$ | none | none | 95 |
| Example 7 | Compound 26 | $CuSO_4$ | none | none | 7 |
| Example 8 | † | † | Compound 1 | $CuSO_4$ | 55 |
| Example 9 | Compound 1 | none | none | $CuSO_4$ | 48 |
| Example 10 | † | † | Compound 3 | $CuSO_4$ | 85 |
| Example 11 | Compound 3 | none | none | $CuSO_4$ | 148 |
| Example 12 | † | † | Compound 4 | $CuSO_4$ | 62 |
| Example 13 | Compound 4 | none | none | $CuSO_4$ | 145 |
| Example 14 | † | † | Compound 6 | $CuSO_4$ | 103 |
| Example 15 | Compound 6 | none | none | $CuSO_4$ | 120 |
| Example 16 | † | † | Compound 8 | $CuSO_4$ | 80 |
| Example 17 | Compound 8 | none | none | $CuSO_4$ | 60 |

TABLE I-continued

| Experiment | Prebath Organic Catalyst | Prebath Co-Catalyst | Bleach Organic Catalyst | Bleach Co-Catalyst | $t_{50}$ (seconds) |
|---|---|---|---|---|---|
| Example 18 | † | † | Compound 9 | $CuSO_4$ | 30 |
| Example 19 | Compound 9 | none | none | $CuSO_4$ | 165 |
| Example 20 | † | † | Compound 22 | $CuSO_4$ | 52 |
| Example 21 | Compound 22 | none | none | $CuSO_4$ | 55 |
| Example 22 | Compound 25 | none | none | $CuSO_4$ | 43 |
| Control G | † | † | 2,5-dihydroxy-benzene sulfonic acid | $CuSO_4$ | 135 |
| Control H | 2,5-dihydroxy benzene sulfonic acid | none | none | $CuSO_4$ | 165 |

† Indicates that a prebath was not used.
*Indicates that bleaching was incomplete after 500 seconds.

In Control B, prebath AB-1a is a known persulfate bleach accelerator solution as described by Sehlin in *SMPTE Journal*, pg. 158, 1982. It is comprised of 0.5 g/l ethylenediaminetetraacetic acid, tetrasodium salt, 3.3 g/l sodium bisulfite, 5 ml/l glacial acetic acid, 3.3 g/l dimethylaminoethanethiol, isothiouronium salt; and was adjusted to pH=4. In Controls C and D, the peroxide bleach solution contained the tris(bypridyl) complexes of cobalt (III) and nickel (II), respectively. These complexes are known persulfate bleach accelerators as described in *Research Disclosure* 15704, May 1977. They were prepared in situ by adding either cobalt nitrate (2 mmol/l) or nickel acetate (2 mmol/l) and 2,2'-bipyridine (10 mmol/l) to the bleaching solution of Control A. The cobalt (III) is formed by peroxide oxidation of cobalt (II).

Referring to Table I, Control A demonstrates that the uncatalyzed hydrogen peroxide solution is a very poor bleach. Controls B–D show that one cannot apply the teachings of persulfate and expect them to work with hydrogen peroxide. Example 1 demonstrates that the organic catalyst can be effective in the bleach solution without the metal co-catalyst, but Example 2 shows that the bleaching rate is greatly enhanced by the presence of the metal co-catalyst. In fact, inspection of Examples 1–7 and Controls A–F illustrate that the combination of organic catalyst and the transition metal co-catalyst provides more than a mere additive effect in increased bleaching capacity of the hydrogen peroxide bleaching agent. Rather, the effect is clearly synergistic because the observed bleaching rates using the combinations are much faster than predicted based on the sum of the individual bleaching rates obtained when either the organic catalyst or transition metal co-catalyst is used alone.

Many of the cationic organic accelerators are equally effective in a prebath as in the bleach. However, neutral accelerators (such as Compound 9) tend to be most effective in the bleach itself. Controls G and H show that the anionic hydroquinone is not an effective hydrogen peroxide bleach catalyst in either the prebath or the bleach, even in the presence of the metal co-catalyst. Other neutral organic catalysts within the scope of this invention may be found to be useful in prebath solutions.

In Example 23, a developer stop solution was used as the prebath solution containing Compound 26 (5 mmol/l) dissolved in acetate buffer (0.3 mmol/l, pH 3.7). A film sample was step exposed and processed using the following protocol:

| | |
|---|---|
| 3.25 minutes | Development (as noted above) |
| 1 minute | Stop solution** |
| 1 minute | Water wash |
| 0–4 minutes | Bleaching (Control B)* |
| 3 minutes | Water wash |
| 4 minutes | Fixing (as noted above) |
| 3 minutes | Water wash |
| 1 minute | KODAK PHOTO-FLO ™ rinse |
| 5 minutes | Dry |

*The hydrogen peroxide was varied from 0.13 to 0.98 mol/1.
**Contained Compound 30.

The silver bleaching was measured as a function of time by X-ray fluorescence, and the results are shown in FIG. 1. Curves 1–4 show the results using 0.13 mol/l, 0.26 mol/l, 0.49 mol/l, and 0.98 mol/l of peroxide, respectively. Bleaching was considered complete when the amount of silver remaining was less than 76 mg/m$^2$.

The invention has been described in detail with particular reference to preferred embodiments thereof, but it will be understood that variations and modifications can be effected within the spirit and scope of the invention.

I claim:

1. A method for processing a photographic element comprising:

treating an imagewise exposed and developed photographic element with a solution that has a pH of from about 3 to about 5, is substantially free of ferric ions, and consists essentially of from about 0.1 to about 2 mol/l of a peroxide or a perborate or percarbonate peroxide precursor bleaching agent and from about 0.0005 to about 0.1 mol/l of an organic carbocyclic or heterocyclic compound which has the following properties:

a) a reduced form which is oxidizable by peroxide or a peroxide precursor at a pH of from about 1 to about 7, b) an oxidized form which is reducible by silver metal in the presence of bromide or chloride at a pH of from about 1 to about 7, and c) a chemically reversible redox couple, versus a saturated calomel electrode, of from about −0.20 to about +1.5 volts at a pH of from about 1 to about 7, said organic carbocyclic or heterocyclic compound having a neutral or net positive charge, and being represented by any of the structures:

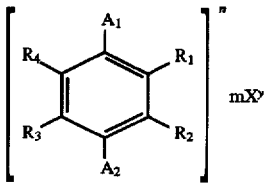

(I)

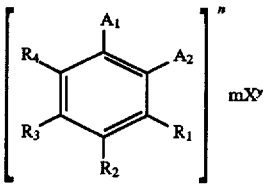

(II)

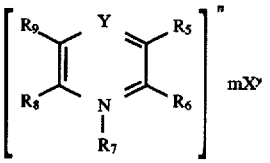

(III)

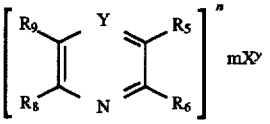

(IV)

wherein

A1 and A2 are independently hydroxy or primary, secondary or tertiary amino,

R1, R2, R3, R4, R5, R6, R7, R8 and R9 are independently hydrogen, halo, cyano, nitro, amide, sulfonamide, hydroxy, an ester, an ether, a primary, secondary or tertiary amino, an alkyl group of 1 to 12 carbon atoms, an aryl group of 6 to 12 carbon atoms in the ring structure, a cycloalkyl group of 5 to 12 carbon atoms in the ring structure or a quaternized aliphatic or aromatic amine or imine, or any two adjacent groups chosen from R1, R2, R3, R4, R5, R6, R7, R8 and R9, can represent the carbon, nitrogen, oxygen and sulfur atoms necessary to complete a 5- to 12-membered fused carbocyclic or heterocyclic ring structure connected to the primary nucleus of structures (I)–(IV), Y is a sulfur, oxygen or nitrogen atom, X is an anion with a charge y of −1 to −3, m is the absolute value of the ratio of n to y, and n is 0 or a positive integer up to 3.

2. The method of claim 1 wherein each of $A_1$ and $A_2$ is hydroxy or tertiary amino, at least one of $R_1$ through $R_9$ is a quaternized aliphatic or aromatic amine or imine, and Y is nitrogen in structure (III) and oxygen or sulfur in structure (IV).

3. The method of claim 2 wherein said quaternized aliphatic aromatic amine or imine is represented by either the structures (V) and (VI):

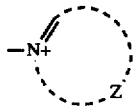

V

-continued

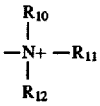

VI wherein Z represents the carbon, oxygen, nitrogen and sulfur atoms necessary to complete a 5- to 12-membered aromatic ring structure which is a pyridyl, pyrimidinyl, pyrazinyl, pyridizinyl, quinolinyl, quinoxalinyl, azonyl, thiazolyl, isopyrrolyl, pyrazolyl, imidazolyl, oxazolyl, isoxazolyl, oxadiazolyl, oxatriazolyl, dioxazolyl, triazinyl, oxazinyl, oxathiazinyl, diazepinyl, indolyl, isodinazolyl, quinolyl, isoquinolyl, indoxazinyl, quinazolinyl, pyridopyridyl, cinnolinyl, benzoxazinyl, pteridinyl, quinolinyl, pyrrolyl, thiopenyl, pyranyl or furazanyl ring, $R_{10}$, $R_{11}$ and $R_{12}$ are independently an alkyl group of 1 to 12 atoms, or a cycloalkyl group of 5 to 12 carbon atoms in the ring structure, or any two adjacent groups chosen from $R_1$, $R_2$, $R_3$, $R_4$, $R_5$, $R_6$, $R_7$, $R_8$ and $R_9$, can represent the carbon, nitrogen, oxygen and sulfur atoms necessary to complete a 5- to 12-membered fused carbocyclic or heterocyclic ring structure connected to the primary nucleus of structures (I)–(IV), said carbocyclic or heterocyclic ring structure being a pyridyl, pyrimidinyl, pyrazinyl, pyridizinyl, quinolinyl, quinoxalinyl, azonyl, thiazolyl, isopyrrolyl, pyrazolyl, imidazolyl, oxazolyl, isoxazolyl, oxadiazolyl, oxatriazolyl, dioxazolyl, triazinyl, oxazinyl, oxathiazinyl, diazepinyl, indolyl, isodinazolyl, quinolyl, isoquinolyl, indoxazinyl, quinazolinyl, pyridopyridyl, cinnolinyl, benzoxazinyl, pteridinyl, quinolinyl, pyrrolyl, thiopenyl, pyranyl, furazanyl, thiophenyl, furanyl, pyronyl, dioxinyl, oxazinyl, pyranyl, dioxazolyl or cyclohexenyl ring.

4. The method of claim 1 wherein said organic compound is selected from the group consisting of:

5,8-dihydroxy-4a-azoniaanthracene bromide (Compound 1), 5,6-dihydroxy-4a-azoniaanthracene bromide (Compound 2), N-(2,5-dihydroxyphenyl)pyridinium chloride (Compound 3), N-[methyl(2,5-dihydroxy-4-methylphenyl)]pyridinium chloride (Compound 4), N-[methyl(2,5-dihydroxy-4-methyl)]isoquinolinium chloride (Compound 5), N-[(methyl(2,5-dihydroxy-4-methyl)]quinolinium chloride (Compound 6), 2,5-dihydroxyphenyltrimethylammonium chloride (Compound 7), N,N'-di(2,5-dihydroxyphenyl)-4,4'-bipyridinium dichloride (Compound 8), hydroquinone (Compound 9), bromohydroquinone (Compound 10), 2,5-dibromohydroquinone (Compound 11), tetrabromohydroquinone (Compound 12), methylhydroquinone (Compound 13), 2,5-dimethylhydroquinone (Compound 14), tetramethylhydroquinone (Compound 15), catechol (Compound 16), 1,3-dihydroxynaphthalene (Compound 17), 1,2-dihydroxynaphthalene (Compound 18), 4-(N,N-dimethylamino)phenol (Compound 19), 2-bromo-4-(N,N-dimethyl)phenol (Compound 20), 2-methyl-4-(N,N'-dimethylamino)phenol (Compound 21), N,N,N',N'-tetramethylparaphenylenediamine (Compound 22), bromo-N,N,N',N'-tetramethylparaphenylenediamine (Compound 23), methyl-N,N,N',N'-tetramethylparaphenylenediamine (Compound 24), Bindshedler's Green (Compound 25), N-methylphenazinium methosulfate (Compound 26), phenazine (Compound 27), phenoxazine (Compound 28), and phenothiazine (Compound 29).

5. The method of claim 1 wherein said solution further comprises from about 0.0001 to about 0.05 mol/l of a transition metal ion having an oxidation state of (I), (II) or (III).

6. The method of claim 5 wherein said transition metal ion is copper(I), copper(II), cobalt(II), cobalt(III) or nickel(II).

7. The method of claim 6 wherein said transition metal is copper(II) which is present in an amount of from about 0.0005 to about 0.002 mol/l.

8. The method of claim 1 wherein said solution is a bleaching solution comprising a hydrogen peroxide bleaching agent.

9. The method of claim 8 wherein said bleaching agent is hydrogen peroxide.

10. The method of claim 8 wherein said solution further comprises a rehalogenating agent.

11. The method of claim 1 wherein said solution further includes from 0.0001 to 0.05 mol/l of a transition metal ion which is copper(I), copper(II) or nickel(II).

12. The method of claim 1 wherein said solution further comprises a rehalogenating agent in an amount of from about 0.02 to about 2 mol/l.

13. The method of claim 1 wherein said organic compound is present in an amount of from about 0.001 to about 0.01 mol/l.

14. The method of claim 13 wherein said organic compound is present in an amount of from about 0.001 to about 0.05 mol/l.

* * * * *